US008164241B2

(12) United States Patent
Miller et al.

(10) Patent No.: US 8,164,241 B2
(45) Date of Patent: Apr. 24, 2012

(54) EXTENSION-TYPE SPARK PLUG

(75) Inventors: Kevin L. Miller, Ida, MI (US); Richard E. Callahan, Maumee, OH (US)

(73) Assignee: Federal Mogul Ignition Company, Southfield, MI (US)

( * ) Notice: Subject to any disclaimer, the term of this patent is extended or adjusted under 35 U.S.C. 154(b) by 239 days.

(21) Appl. No.: 12/541,442

(22) Filed: Aug. 14, 2009

(65) Prior Publication Data

US 2010/0068905 A1 Mar. 18, 2010

Related U.S. Application Data

(60) Provisional application No. 61/089,107, filed on Aug. 15, 2008.

(51) Int. Cl.
*H01T 13/20* (2006.01)

(52) U.S. Cl. ..... 313/136; 313/137

(58) Field of Classification Search ..... 313/118–145
See application file for complete search history.

(56) References Cited

U.S. PATENT DOCUMENTS

| | | | | |
|---|---|---|---|---|
| 2,255,203 | A * | 9/1941 | Wiegand | 313/11.5 |
| 3,050,658 | A * | 8/1962 | Lay et al. | 315/85 |
| 4,275,334 | A | 6/1981 | Beeghly | |
| 4,308,487 | A | 12/1981 | Feaster | |
| 4,949,006 | A | 8/1990 | Oshima et al. | |
| 5,204,579 | A | 4/1993 | Oshima et al. | |
| 6,437,492 | B1 | 8/2002 | Geissinger et al. | |
| 6,621,196 | B1 | 9/2003 | Geissinger et al. | |
| 7,053,623 | B2 * | 5/2006 | McMurray et al. | 324/402 |
| 7,825,573 | B2 * | 11/2010 | Callahan et al. | 313/143 |
| 2005/0056087 | A1 * | 3/2005 | Kiess et al. | 73/116 |
| 2008/0054777 | A1 * | 3/2008 | Callahan et al. | 313/143 |

FOREIGN PATENT DOCUMENTS

JP 07-022158 A 1/1995

* cited by examiner

*Primary Examiner* — Nimeshkumar Patel
*Assistant Examiner* — Christopher Raabe
(74) *Attorney, Agent, or Firm* — Robert L. Stearns; Dickinson Wright, PLLC

(57) ABSTRACT

An extension-type spark plug includes an upper terminal stud and a lower terminal stud axially spaced from one another in electrical communication with one another. An upper tubular insulator having a through cavity surrounds at least a portion of the upper terminal stud. A lower insulator constructed of a separate piece of material from the upper insulator has a through cavity surrounding at least a portion of the lower terminal stud. A spring member is disposed between the upper terminal stud and the lower terminal stud and biases the upper terminal stud and the lower member away from one another. The spring member allows the upper terminal stud to move axially under an externally applied force sufficient to overcome the bias imparted by the spring member and maintains electrical communication between said upper terminal stud and said lower terminal stud.

10 Claims, 1 Drawing Sheet

EXTENSION-TYPE SPARK PLUG

CROSS-REFERENCE TO RELATED APPLICATION

This application claims the benefit of U.S. Provisional Application Ser. No. 61/089,107, filed Aug. 15, 2008, which is incorporated herein by reference in its entirety.

BACKGROUND OF THE INVENTION

1. Field of the Invention

The present invention relates generally to spark plugs for igniting combustion gases in a combustion chamber of an internal combustion engine, and more particularly to extension-type spark plugs used in applications having limited access space.

2. Related Art

Spark plugs are used in a variety of internal combustion engine applications and are configured along with other accessory parts to fit within a given operating environment. For example, in a particular engine application the depth of a bore in the engine in which the spark plug is received may require the use of a separate spark plug extension to connect the spark plug to a spark plug wire. While designs with accessory extension pieces generally meet their intended purpose, problems still persist. For example, spark plug designs having multiple separate pieces can cause manufacturing and service logistic issues, aside from adding cost to the manufacturing process. Further, the more complex designs require retrofit instructions. Moreover, such designs having multiple separate pieces require field assembly and, thus, have a reduced reliability.

Therefore, it would be desirable to reduce the number of separate components required to install a spark plug in a given operating environment to reduce assembly complexity and costs associated therewith. Moreover, the new and improved spark plug design should be economical in manufacture and exhibit a long and useful life.

SUMMARY OF THE INVENTION

In accordance with an aspect of the invention, an extension-type spark plug includes a tubular housing and an upper insulator received at least in part in the housing. The upper insulator has a through cavity extending between a terminal end and a distal end. The cavity has an upper diameter portion and a lower diameter portion separated from one another by a radially extending shoulder, wherein the upper diameter portion has a reduced diameter from the lower diameter portion. A lower insulator constructed of a separate piece of material from the upper insulator is received at least in part in the housing. The lower insulator has a through cavity extending between opposite ends. A firing electrode is fixed in the through cavity of the lower insulator and extends axially outwardly of one of the ends of the lower insulator. A lower terminal stud is fixed in the through cavity of the lower insulator at the end opposite the firing electrode. An upper terminal stud extends between terminal and distal ends and has an enlarged head with one diameter at the terminal end and an elongate body with a diameter less than the one diameter extending from the head to the distal end. A spring member engages the distal end of the upper terminal stud and the lower terminal stud and biases the enlarged head of the upper terminal stud into abutment with the shoulder of the upper insulator and provides and maintains electrical communication between the upper terminal stud and the lower terminal stud.

In accordance with another aspect of the invention, the upper terminal stud is free to move axially out of engagement with the shoulder under an external force applied on the terminal end of the upper terminal stud that is sufficient to overcome the bias imparted by the spring member.

In accordance with another aspect of the invention, the tolerance limits of manufacture for the spark plug can be increased due to the ability of the upper terminal stud to move axially within the upper insulator. Accordingly, manufacture of the spark plug is made more economical. Further, the useful life of the spark plug is enhance by allowing the upper terminal stud to self adjust in manufacture and in use.

BRIEF DESCRIPTION OF THE DRAWINGS

These and other aspects, features and advantages of the present invention will become more readily appreciated when considered in connection with the following detailed description and best mode, appended claims and accompanying drawings, in which:

DETAILED DESCRIPTION OF A PRESENTLY PREFERRED EMBODIMENT

Figure 1:
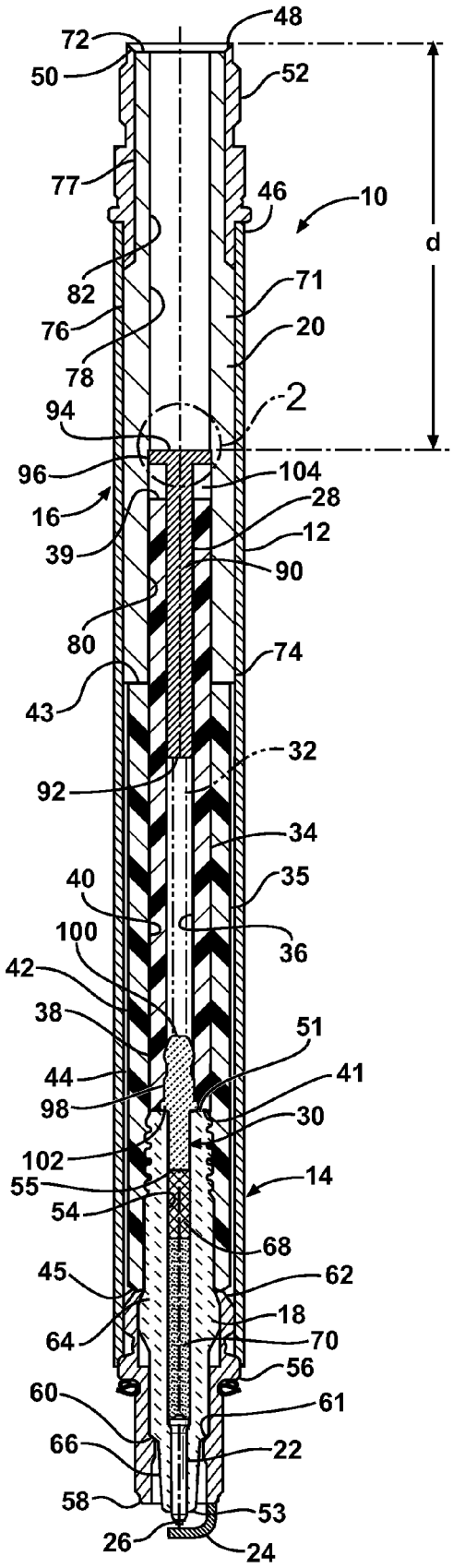
FIG. 1 is a cross-sectional view through an extension spark plug constructed in accordance with one aspect of the invention.

Referring in more detail to the drawings, FIG. 1 illustrates a cross-sectional view of an extension-type spark plug 10 constructed in accordance with one presently preferred embodiment of the invention. The spark plug 10 is of the type used in industrial engine and other specialized applications where access to the spark plug 10 for maintenance and replacement purposes is severely limited. The spark plug 10 includes an installation housing or conduit 12 made of a metal material such as stainless steel or some alloy of steel, for example. The installation conduit 12 houses a lower assembly, generally indicated at 14, and an upper assembly, generally indicated at 16. Both the lower 14 and upper 16 assemblies are constructed, at least in part, from a dielectric material such as ceramic, including a respective dielectric lower insulator 18 and a dielectric upper insulator 20. The lower insulator 18 houses a firing electrode 22 in proximate relation to a ground electrode 24 with a spark gap 26 being provided between the respective firing and ground electrodes 22, 24. The upper assembly 16 has a upper terminal stud 28 arranged in operable electrical communication with a power source (not shown) and the lower assembly 14 has a lower member, such as a terminal stud 30 by way of example and without limitation, arranged in operable electrical communication with the firing electrode 22. A spring member 32 is disposed between the upper terminal stud 28 and the lower terminal stud 30. The spring member 32 imparts a bias between the upper terminal stud 28 and the lower terminal stud 30 to bias the upper terminal stud 28 away from the lower terminal stud 30. In addition to providing an axial spring bias, the spring member 32 provides and maintains electrical communication between the upper and lower terminal studs 28, 30. As such, the upper and lower terminal studs 28, 30 can each be constructed having a generally wide or large axial tolerance, as the spring member 32 can be axially compressed to take up any excess length, while also being able to expand axially to account for any length deficiencies in the upper and lower terminal studs 28, 30. As such, the spark plug 10 is economical in manufacture, while also having a long and useful life.

The lower assembly 14 and upper assembly 16 are coupled together at least in part by an inner sleeve insulator 34 and an outer sleeve insulator 35 which, together with the dielectric portions of the lower 14 and upper 16 assemblies, prevents electrical conduction between the upper terminal stud 28, the spring member 32, the lower terminal stud 30 and the grounded installation conduit 12. The inner and outer sleeve insulators 34, 35 are made of a non-conducting material, such as a silicone rubber or polymer, for example. The inner sleeve insulator 34 is shown as having a straight, cylindrical cavity 36 sized for a close sliding fit with an outer surface of each the upper and lower terminal studs 28, 30, such that the terminal studs 28, 30 are able to slidably move therein. The inner sleeve insulator 34 is also shown as having a straight, cylindrical outer surface 38 extending between opposite upper and lower ends 39, 41, thereby allowing the inner sleeve insulator 34 to be readily extruded in manufacture. The outer surface 38 is shown as being received at least in part within the upper insulator 20 for a close, fixed fit therein.

The outer sleeve insulator 35 is shown as having a straight, cylindrical cavity 40 sized for a close fit with the outer surface 38 of the inner sleeve insulator 34 and for receipt of the lower insulator 18. Accordingly, the inner insulator 34 is substantially fixed against relative axial movement with the outer insulator 35. The outer sleeve insulator 35 is also shown as having a straight, cylindrical outer surface 42 extending between opposite upper and lower ends 43, 45, thereby allowing the outer sleeve insulator 35 to be readily extruded in manufacture. The outer surface 42, by way of example and without limitation, is shown as being received in a loose fit within the installation conduit 12, such that an annular gap 44 is provided between the outer surface 42 and the conduit 12. However, the outer surface 42 could be configured for a tight fit with the conduit 12, if desired.

The installation conduit 12 has a proximal end 46 with a bushing 48 connected thereto by welding, crimping, or any other suitable attachment mechanism. The bushing 48 has an end 50 including threads 52 for connection to a spark plug wire (not shown). As conventionally known, the spark plug wire is connected to an external energy source. The bushing 48 can have a hexagon segment configuration compatible with industry standard socket wrench tooling for installation/removal purposes. The bushing 48 is preferably metallic and is electrically connected to ground through the metallic installation conduit 12.

The lower assembly 14 includes the firing end of the spark plug 10. A high voltage pulse from an external ignition system is applied to the lower assembly 14 through the upper terminal stud 28, the spring member 32 and the lower terminal stud 30. The lower assembly 14 includes the lower insulator 18 for preventing the high voltage pulse supplied to spark plug 10 from leaking outwardly to the installation conduit 12. The lower insulator 18 is typically made of alumina ceramic or a similar material. The lower insulator 18 has a cavity 54 extending between opposite upper and lower ends 51, 53, with the cavity 54 being sized adjacent one end 51 for receipt of an end 55 of the lower terminal stud 30. The lower insulator 18 is captured by a lower shell 56. The lower shell 56 has a first end 58 that is threaded to threadedly engage a bore in the engine (not shown). The lower insulator 18 has a lower seat 60, that when positioned within the lower shell 56, is pressed against a complementary ledge or seat 61 in the lower shell 56. A second end 62 of the lower shell 56 engages the lower insulator 18 at an upper shoulder 64 of the insulator 18. Thus, the lower insulator 18 is retained within the lower shell 56 by crimping the end 62 over the upper shoulder 64 while the lower seat 60 bears against the complementary seat 61 of the shell 56. The ground electrode 24 is represented as being attached to the end 58 of the shell 56, and is further shown as being generally L-shaped to position a firing surface of the ground electrode 24 in axially spaced relation to a firing surface of the firing electrode 22 across the spark gap 26. It should be recognized that other suitable ground electrode configurations are contemplated herein, such as annular configurations providing an annular spark gap, for example.

The firing electrode 22 is disposed partially within a nose portion 66 of the lower insulator 18. A radio frequency suppressor capsule 68, and a conductive glass seal 70 are disposed between the firing electrode 22 and the lower terminal stud 30. Those of skill in the art of spark plug construction will appreciate various other intermediate conduction path configurations between the lower terminal stud 30 and the firing electrode 22. For example, a fired-in suppressor seal pack may be substituted. Other constructions are also possible. The suppressor capsule 68 or other RFI device is provided to reduce the effects of electromagnetic interference (EMI) on peripheral devices such as radios.

Figure 2:
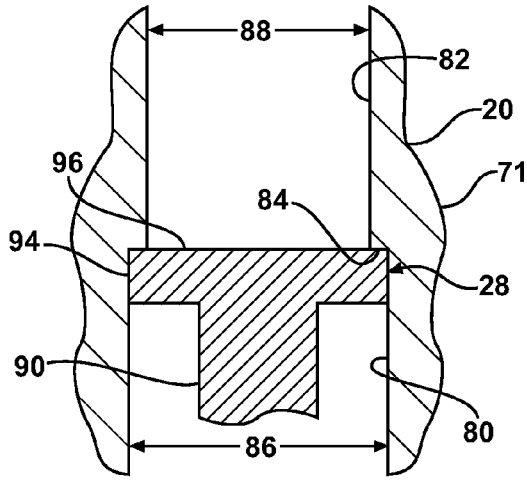
FIG. 2 is an enlarged view of the encircled area 2 of FIG. 1.

The upper assembly 16 includes the upper insulator 20 which has a tubular wall 71 with an outer surface 76 and an inner surface 78 extending between a proximal or terminal end 72 and a distal end 74. The outer surface 76 is shown having a portion extending from the distal end 74 toward the terminal end 72 having an outer diameter sized for a close fit within the installation conduit 12. The outer surface 76 also has a reduced diameter portion 77 adjacent the terminal end 72. Further, the inner surface 78 of the tubular wall 71 has a first portion 80 extending from the distal end 74 toward the terminal end 72. The first portion 80 transitions to a second portion 82 at a radially inwardly extending shoulder 84 (FIG. 2). As such, the first portion 80 has a first diameter 86 and the second portion 82 has a second diameter 88, wherein the first diameter 86 is greater than the second diameter 88. The second portion 82 is constructed to extend over a predetermined length from adjacent the terminal end 72 toward the distal end 74, and thus, the shoulder 84 providing the transition from the first diameter 86 to the second diameter 88 is strategically located a predetermined distance (d) from the terminal end 72. In one example, wherein a stinger (not shown) has a length of about 2", the distance d of the shoulder 84 from the terminal end 72 is set to substantially match the length of the stinger, and thus, is set in this example to be about 2". It is to be understood that the distance from the shoulder 84 from the terminal end 72 is to correspond with the length of the stinger used in the spark plug application.

The upper terminal stud 28 has an elongate body 90 extending from a distal end 92 to a proximal end 94. The body 90 is generally cylindrical, with the exception of an enlarged head 96 formed at the proximal end 94. As such, the body 90 is generally T-shaped in axial cross-section. The cylindrical length of the body 90 is sized for a loose, sliding receipt in the cavity 36 of the inner sleeve insulator 34. The head 96 is maintained outwardly from the inner sleeve insulator 34 and is sized to confront the shoulder 84 in the upper insulator 20. Accordingly, the shoulder 84 obstructs the head 96 from moving axially upwardly beyond the shoulder 84. The head 96 is also sized for a loose, sliding movement relative to the second portion 82 of the upper insulator 20. Accordingly, the head 96 is free to slide axially downwardly from the shoulder 84 given sufficient force on the head 96 to overcome the axial bias imparted by the spring member 32.

The lower terminal stud 30 has an elongate body 98 extending between the distal end 55 and a proximal end 100. The distal end 55 is configured to be fixed within the cavity 54 of the lower insulator 18, and the proximal end 100 is configured to be received within the cavity 36 of the inner sleeve insulator 34. A flange 102 extends radially outwardly from the body 98 between the ends 55, 100. The flange 102 is configured to abut the end 51 of the lower insulator 18 and an end of the inner insulator 34.

Upon disposing the inner sleeve insulator 34, the outer sleeve insulator 35, and lower assembly 14 and the upper assembly 16 within the housing 12, the bushing 48 is placed into housing 12 and then welded or otherwise mechanically fastened to the housing 12 to secure the upper insulator 20 within the housing 12. Further, the end 62 of the lower shell 56 is disposed and fixed within the housing 12. During the assembly process, the upper end 43 of the outer insulator 35 is brought into abutment with the distal end 74 of the upper insulator 20 and the lower insulator 18 is received at least in part in the lower end 45 of the outer insulator 45. The head 96 of the upper terminal stud 28 engages the shoulder 84 and the spring member, such as a coil spring, for example, is compressed under spring force between the distal end 92 of the upper terminal stud 28 and the proximal end 100 of the lower terminal stud 30. Accordingly, continuous electrical communication is established and maintained between the upper and lower terminal studs 28, 30 in use via the axially compressed spring member 32. The spring member 32 further allows the upper terminal stud 28 to be automatically adjusted and moved axially downwardly and out of engagement with the shoulder 84 when an external force sufficient to overcome the bias imparted by the spring member 32 is applied to the proximal end 94 of the upper terminal stud 28. This is permitted by providing a clearance region 104 between the head 96 and the upper end 39 of the inner sleeve insulator 34. To maintain the clearance region 104, the inner sleeve insulator 34 can be fixed axially relative to the outer sleeve insulator 35, with the lower end 41 of the inner sleeve insulator 35 abutting the upper end 51 of the lower insulator 18. Accordingly, the upper terminal stud 28 is able to move axially in a plunging type movement under a bias force sufficient to overcome the bias force of the spring member 32.

The foregoing invention has been described in accordance with an exemplary embodiment, and thus, is not intended to be limiting. Variations and modifications to the disclosed embodiment will be apparent to those skilled in the art, wherein the variations and modifications are encompassed within the scope of the invention. Accordingly, the scope of legal protection afforded this invention are bounded only by the following claims.

What is claimed is:

1. An extension-type spark plug, comprising:

a tubular housing;

an upper insulator received at least in part in said housing, said upper insulator having an inner surface presenting a through cavity extending between a terminal end and a distal end and having an upper diameter portion and a lower diameter portion separated from one another by a radially extending shoulder, said upper diameter portion having a reduced diameter from said lower diameter portion;

a lower insulator constructed of a separate piece of material from said upper insulator received at least in part in said housing, said lower insulator having a through cavity extending between opposite ends;

a firing electrode fixed in said through cavity of said lower insulator and extending axially outwardly of one of said ends;

a lower terminal stud fixed in said through cavity of said lower insulator at the end opposite said firing electrode;

an upper terminal stud disposed in said through cavity and along said inner surface of said upper insulator;

said upper terminal stud extending between proximal and distal ends and having an enlarged head with one diameter at said proximal end and an elongate body extending from said enlarged head to said distal end and having a diameter less than said one diameter of said enlarged head at said distal end such that said enlarged head and said elongate body and said inner surface of said upper insulator provide a clearance region therebetween; and a spring member engaging said distal end of said upper terminal stud and said lower terminal stud to provide electrical communication between said upper terminal stud and said lower terminal stud, said spring member having a bias force for biasing said enlarged head of said upper terminal stud into abutment with said shoulder of said upper insulator and allowing said enlarged head to move axially out of abutment with said shoulder into said clearance region under an external force applied on said upper terminal stud, said external force being sufficient to overcome said bias force of said spring member.

2. The extension-type spark plug of claim 1 further comprising a tubular outer insulator received in said housing, said tubular outer insulator having one end abutting said distal end of said upper insulator and another end receiving said lower insulator at least in part therein.

3. The extension-type spark plug of claim 2 further comprising a tubular inner insulator received in said tubular outer insulator.

4. The extension-type spark plug of claim 3 wherein said tubular inner insulator has one end receiving said lower terminal stud therein and another end spaced axially from said enlarged head of said upper temiinal stud to provide said clearance region between said enlarged head and said elongate body and said inner insulator.

5. The extension-type spark plug of claim 4 wherein said tubular inner insulator has a through cavity sized to receive said elongate body of said upper terminal stud at least partially therein.

6. The extension-type spark plug of claim 5 wherein said elongate body is received in a loose fit within said through cavity of said tubular inner insulator.

7. The extension-type spark plug of claim 5 wherein said spring member is received in said though cavity of said tubular inner insulator.

8. The extension-type spark plug of claim 3 wherein said tubular inner insulator is substantially fixed against axial movement relative to said tubular outer insulator.

9. The extension-type spark plug of claim 2 wherein said tubular outer insulator has an outer surface spaced from said housing to provide an annular gap between said tubular outer insulator and said housing.

10. The extension-type spark plug of claim 1 wherein said enlarged head of said upper terminal stud is received in a loose fit with said lower diameter portion of said through cavity of said upper insulator.

* * * * *